US009489783B2

(12) United States Patent
Frank

(10) Patent No.: US 9,489,783 B2
(45) Date of Patent: Nov. 8, 2016

(54) DOOR SYSTEM WITH NONCONTACT ACCESS CONTROL AND NONCONTACT DOOR OPERATION

(71) Applicant: FRANK TÜREN, Buochs (CH)
(72) Inventor: Marcel Frank, Ennetbuergen (CH)
(73) Assignee: Frank Türen AG, Buochs (CH)

( * ) Notice: Subject to any disclaimer, the term of this patent is extended or adjusted under 35 U.S.C. 154(b) by 0 days.

(21) Appl. No.: 14/440,532
(22) PCT Filed: Nov. 14, 2013
(86) PCT No.: PCT/CH2013/000200
§ 371 (c)(1),
(2) Date: Sep. 1, 2015
(87) PCT Pub. No.: WO2014/078970
PCT Pub. Date: May 30, 2014
(65) Prior Publication Data
US 2015/0379792 A1 Dec. 31, 2015
(30) Foreign Application Priority Data
Nov. 20, 2012 (CH) ..... 2431/12
(51) Int. Cl.
*G07C 9/00* (2006.01)
*E05F 15/60* (2015.01)
(Continued)
(52) U.S. Cl.
CPC ..... *G07C 9/00079* (2013.01); *E05F 15/60* (2015.01); *E05F 15/73* (2015.01);
(Continued)
(58) Field of Classification Search
CPC ..... E07C 9/00079; E07C 9/00158; E07C 9/00817; E07C 9/00563; E05F 15/77; E05F 15/73; E05F 15/60; E05F 15/74; G07C 2009/00825
USPC ..... 49/31, 70
See application file for complete search history.

(56) References Cited

U.S. PATENT DOCUMENTS 4,929,005 A 5/1990 Heinen
6,720,861 B1 4/2004 Rodenbeck
(Continued)

FOREIGN PATENT DOCUMENTS

WO WO 99/54576 A1 10/1999
WO WO 2006/104383 A1 10/2006
(Continued)

*Primary Examiner* — Jerry Redman
(74) *Attorney, Agent, or Firm* — Edwin D. Schindler

(57) ABSTRACT

A door system includes a door frame, at least one door leaf and a door drive with a control unit. The door leaf is equipped with a hand vein scanner for detecting the hand vein profile when a hand is held a distance in front of the hand vein scanner for recognizing the user. A programmable computer with a memory element, in which a plurality of user hand vein profiles can be stored, is housed in the interior of the door leaf. A hand vein profile is compared to the hand vein profiles stored in the memory of the computer and, depending on a match, the door is opened or not. The computer is programmed and supplied with power via a network interface that terminates in the edge of the door leaf or the peripheral area and is the only interface between the door leaf and the door frame, other than a signal cable for the control unit for the door drive. The computer can be programmed by temporarily connecting an external computer to this network interface. The network interface is also used for connecting a power supply for the computer.

16 Claims, 2 Drawing Sheets

Figure 1:
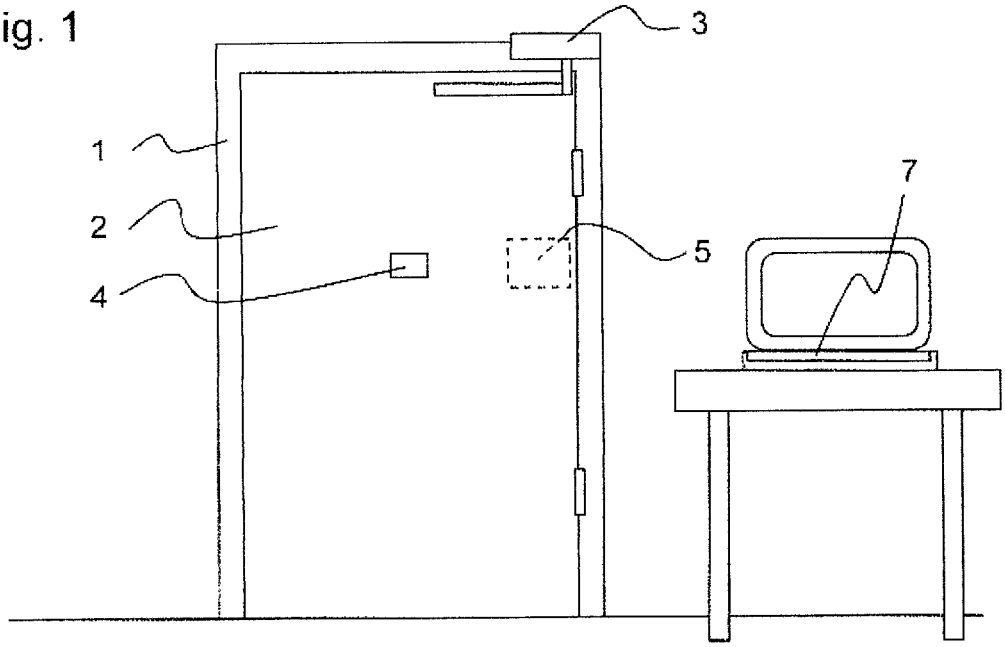

(51) Int. Cl.
*E05F 15/73* (2015.01)
*E05F 15/74* (2015.01)
*E05F 15/77* (2015.01)

(52) U.S. Cl.
CPC ..... *E05F 15/74* (2015.01); *E05F 15/77* (2015.01); *G07C 9/00158* (2013.01); *G07C 9/00563* (2013.01); *G07C 9/00817* (2013.01); *E05F 2015/763* (2015.01); *E05F 2015/765* (2015.01); *G07C 2009/00634* (2013.01); *G07C 2009/00825* (2013.01)

(56) References Cited

U.S. PATENT DOCUMENTS 7,676,068 B2 * 3/2010 Cervantes ..... 382/115
7,899,217 B2 * 3/2011 Uludag et al. ..... 382/115
8,064,645 B1 * 11/2011 Sezille ..... 382/115
8,085,992 B1 * 12/2011 Sahin et al. ..... 382/115
8,923,573 B2 * 12/2014 Shinzaki ..... 382/115
8,977,648 B2 * 3/2015 Shiell et al. ..... 707/797
9,013,271 B2 * 4/2015 Aoki ..... 340/5.82
9,054,875 B2 * 6/2015 Hama
9,208,391 B2 * 12/2015 Aoki
9,224,057 B2 * 12/2015 Bertin
2002/0133725 A1 * 9/2002 Roy et al. ..... 713/202
2003/0167693 A1 9/2003 Mainini
2004/0024694 A1 * 2/2004 Lawrence et al. ..... 705/38
2008/0063244 A1 * 3/2008 Tanaka et al. ..... 382/115
2008/0226136 A1 * 9/2008 Takaku et al. ..... 382/115
2008/0298642 A1 * 12/2008 Meenen ..... 382/115
2009/0243798 A1 * 10/2009 Fukuda et al. ..... 340/5.82
2009/0245585 A1 * 10/2009 Manabe et al. ..... 382/107
2009/0265990 A1 10/2009 Strathmann
2010/0045788 A1 * 2/2010 Zhang et al. ..... 348/77
2010/0198078 A1 * 8/2010 Abe ..... 600/473
2010/0322484 A1 * 12/2010 Hama et al. ..... 382/115
2012/0055763 A1 3/2012 Chou
2012/0082348 A1 * 4/2012 Fukuda et al. ..... 382/115
2012/0250954 A1 * 10/2012 Nada et al. ..... 382/124
2013/0048726 A1 * 2/2013 Cunningham, IV ..... 235/440
2013/0114863 A1 * 5/2013 Kamata et al. ..... 382/115
2015/0031031 A1 * 1/2015 Harrold et al. ..... 435/6.11
2015/0213321 A1 * 7/2015 Okazaki

FOREIGN PATENT DOCUMENTS

WO WO 2012/022398 A1 2/2012
WO WO 2012/041826 A1 4/2012

* cited by examiner

DOOR SYSTEM WITH NONCONTACT ACCESS CONTROL AND NONCONTACT DOOR OPERATION

BACKGROUND OF THE INVENTION

1. Technical Field of the Invention

This invention relates to a door system, which allows contactless access control, and also contactless door operation. Instead of using a conventional key which needs to be inserted into a lock and turned, there are other types of doors or options for doors for which other unlocking methods are used. The electronic key in credit card format, as used in many hotels, is already known. But even here, the key needs to be carried along and may get lost. In addition, the doors have to be opened by hand after unlocking by pressing a door latch or turning a door knob, and the door has to then be pushed open, often against the force of a door driver. Many versions of doors that open and close automatically are known.

2. Description of the Prior Art

There are door access control systems and automatic doors that can be operated without a key but with physical touch, for example using a fingerprint sensor, which can read and identify the individual minutiae, that is the ends and branches of the papillary lines of the human fingerprint when a fingertip is placed on a sensor, which is often installed in the wall next to the door or even in the door panel. Such a system is described, for example in WO 2012/022398. However, for hygienic reasons a solution is needed which completely eliminates physical touch both for access control and for operating the door, such that a person who passes through the door does not leave any traces on the surface of the door. Especially in hospitals and other buildings, where the hygiene requirements are high, such a solution would be very much welcome because doors are one of the main carriers of bacteria and viruses of all kinds at present. Every person who goes in and out, touches the door handle, which acts like a temporary storage and carrier for these micro-organisms. The automatically operated doors, where neither the door handle nor the door is touched, prevent such transmission of micro-organisms. They work using motion sensors. The door opens as soon as a person stands in front of it. But if access should be given only to specific people, then there is still no system that is really convincing.

What has been previously used mainly in high-security wings and strong rooms of banks, is the identification of persons using the so-called iris identification. This is a biometric method where a picture is taken of the iris using a special camera and whose characteristic features are evaluated and compared with the templates already stored in the computer. However, the iris-identification method has significant disadvantages: In case of unfavourable identification conditions of the eye, like for example, people who wear glasses or people of Asian origin having narrow eyelids, even those whose iris is already recorded, cannot be identified by the system. In addition, it takes some time for a retina scan to be completed. This is cumbersome and unnerving for the user because he/she should not move the eye for this duration and should not blink. The user feels the scan as a prick in the eye, which is perceived as uncomfortable and painful. Due to these and other disadvantages, many of these institutions are going back to an identification process using body contact.

In addition to the contactless iris identification, there are hand vein scanners, which can scan the veins of palm held at a distance of a few millimeters to few centimeters and compare it with the pattern recorded previously, so that a match can be determined, if it was the same hand. Such scanners are described, for example, in US 2012/0055763 or in WO 2012/041826. They are presently used for all kinds of access controls, even separately from a door, which is opened and closed again by hand after unlocking is triggered or is opened using a motor by pushing a button or switch by hand, that is, not contactless.

SUMMARY OF THE INVENTION

The objective of this invention is to specify a door system, which on the one hand provides a contactless and individual access control and, on the other hand, the door can also be automatically opened and closed, so that the opening and closing of the door is also contactless. A person having access authorisation can pass through after contactless access control and door opening. In addition, the objective is also to specify such a door system that can be installed with minimum construction effort where the door frame is kept free of electronic circuits and hence such a door system can be subsequently and easily installed into an existing door frame.

This issue is resolved using a door system that consists of a door frame and at least one door panel and a door drive with control unit, where at least one door panel is fitted with a hand vein scanner for scanning the hand vein profile when the hand is held in front of this hand vein scanner and for identifying the concerned user, a programmable computer with memory element, in which a number of hand vein profiles of the users can be stored, where a hand vein profile scanned as the actual user identification using the hand vein scanner, can be compared with the hand vein profile stored in the memory element of the computer unit and when there is a match, a control signal can be sent by the hand vein scanner via a signal cable or even wirelessly to the external control unit, so that the door can be operated with it using the door drive. And such a door system is characterised by the fact that the programmable computer and its memory element for analysing the sensor signals are integrated in the door panel, with a network interface for programming and power supply that ends in the door panel or edge as the only interface between the door panel and the door frame besides the signal cable for the control unit of the door drive, so that the programmable computer can be programmed by temporarily connecting an external computer to this network interface and the network interface is connected to a power supply for operation.

BRIEF DESCRIPTION OF THE DRAWING FIGURES

This door system is discussed using the drawings and its design and function are explained below.

Figure 2:
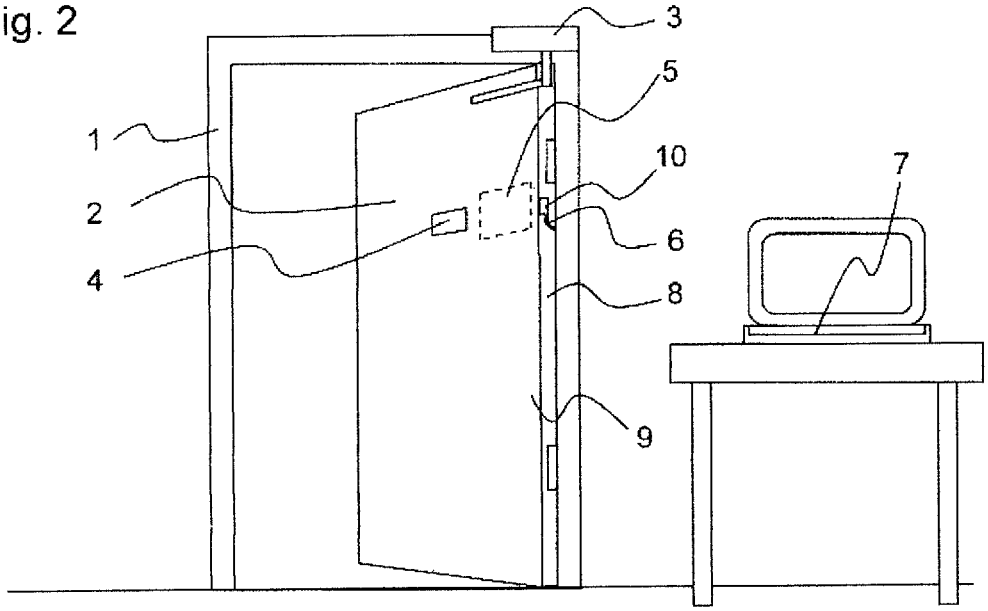
Figure 3:
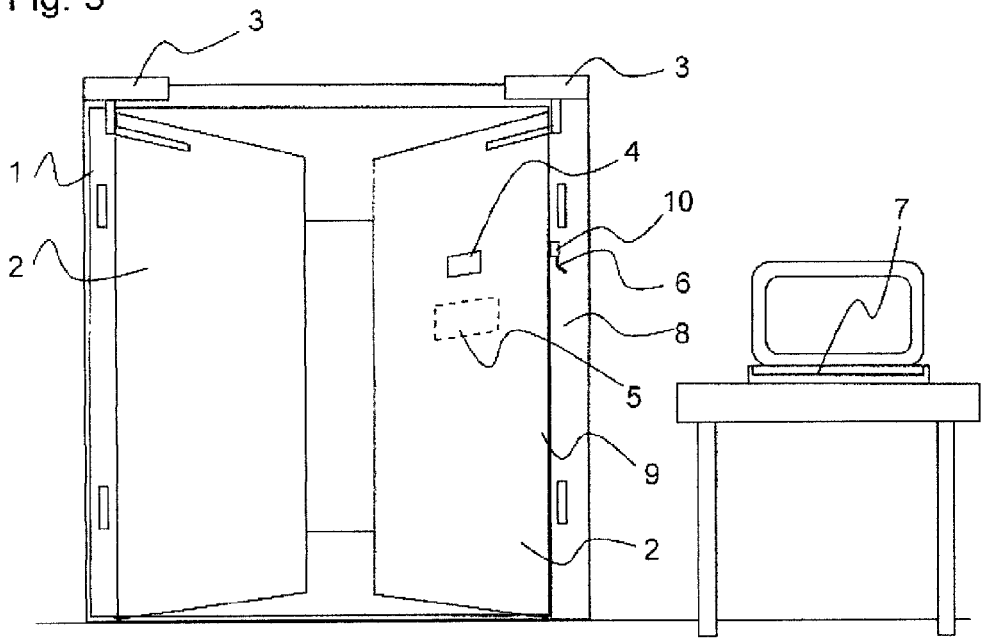
Figure 4:
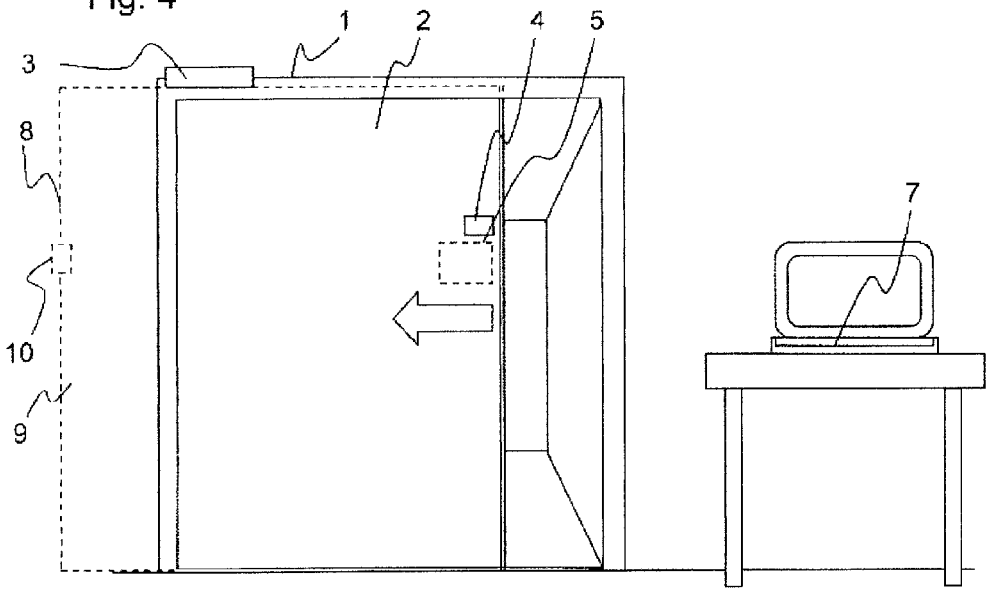

It shows:

FIG. 1: A closed door with a hand vein sensor in the door panel;

FIG. 2: A half-open door with a hand vein sensor in the door panel;

FIG. 3: A door with two panels fitted with a hand vein sensor in one of the two door panels;

FIG. 4: A sliding door fitted with a hand vein sensor in one of the two door panels;

DETAILED DESCRIPTION OF THE DRAWING FIGURES AND PREFERRED EMBODIMENTS

The door system is first discussed using FIG. 1. It consists of a door frame 1 and at least one door panel 2 and a door drive 3 with the associated control unit. The door panel 2 is now fitted with a hand vein scanner 4 as a special feature, for scanning the hand vein profile when the hand is held in front of this hand vein scanner 4. The hand is thus kept a few centimeters in front of the scanner, without touching anything. The system thus identifies the respective user. In a programmable computer unit 5 with memory element, which is also housed as a special feature inside the door panel 2, a number of hand vein profiles of users can be stored. A hand vein profile scanned using the hand vein scanner 4 can then be compared by this computer unit with the hand vein profiles of persons with access authorisation stored in the memory element and access can be given if the profiles match. A corresponding signal is sent in this case to the door drive 3 and the door is opened automatically.

The computer unit 5 is programmed using an external computer 7, for example in the form of a PC. This can be located anywhere. It is only temporarily connected to the computer unit 5 in the door panel for the purpose of programming. The connection can be established using a signal cable 6 or using a wireless network interface 10. This network interface 10, together with the signal cable for the door drive 3, is the only electronic or electrical connection between the door panel and the door frame or even to all the elements outside the door panel 2. It may be implemented, for example as a USB connection or even as a wireless interface, for example based on near field communication technology, Bluetooth, infrared or ultrasound. The programmable computing unit 5 and its memory element for analysing the sensor signals are thus integrated into the door panel 2, with a network interface 10 for programming and power supply that ends in the door edge panel 8 or in the edge region 9 of the door panel 2. By temporarily connecting an external computer 7 to this network interface 10, the computer unit 5 can also be programmed for all the subsequent changes and the same network interface 10 is connected to a power supply for operation.

This door is shown in half-open condition in FIG. 2. As soon as a person holds the hand a few centimeters in front of the hand vein scanner 4 when the door is closed, the access authorisation is checked by the computer unit 5 in the door panel 2 and the door opens automatically and the person can walk through the door frame if he/she has access authorisation. The door then closes automatically, either after a configurable time duration or if a motion sensor on either side of the door frame does not detect any movement near the door. The network interface 10 in the end face of the longitudinal side of the door panel 2 can be seen in FIG. 2. The signal cable 6 is also routed here advantageously.

FIG. 3 shows a version of the door system with double doors. In this case, the hand vein scanner 4 is housed in one of the two door panels or door wing 2, along with the computer unit 5 and its memory. Everything works identical to that of a single door panel, the only difference is that the control signal is sent to two door drives 3 in this case, which are connected using a cable.

FIG. 4 shows a version with a sliding door 2. In the example shown, the hand vein scanner 4 is positioned near the edge of the door panel which is pushed over the width of the door. The hand vein scanner 4 is thus still visible and accessible, even when the sliding door has been pushed to the left and is fully open as shown by the arrow. Thus, the control system can also be designed so that the open door can be closed using the hand vein scanner 4 specifically by authorised persons. If the door should be opened only by authorised persons and then close automatically again, then the hand vein scanner 4 can also be arranged at any other place in the door panel.

The main advantage of this door system is that everything related to the access control is housed in the door panel. It therefore does not require any structural changes, if such a control system needs to be set up subsequently. This is a significant simplification and reduces the installation costs significantly. The external computer 7 can be located anywhere and it is only temporarily connected to the computer unit 5 inside the door panel via a USB interface or even connected wirelessly for programming purposes. This door system can be implemented for all conceivable doors, especially on garage doors, letterboxes, courtyard entrance doors, portals, barn doors, shop doors, warehouse doors, etc. What is attractive is the time recording which the system allows. Thanks to the system, it is easy to record who passed through the door at what time and in which direction.

The invention claimed is:

1. A door system, comprising:

a door frame;

a door panel within said door frame, said door panel having a hand vein scanner within said door panel for scanning a hand vein profile when a hand of a person is held before said hand vein scanner for identifying the person, said door panel having a first front planar panel side and a second rear planar panel side with a single said hand vein scanner being accessible to scan the hand of a person held before said hand vein scanner positioned in front of the first front planar panel side or when the hand of the person is held before said hand vein scanner when positioned in front of the second rear planar panel side, depending upon which direction the person seeks to pass through said door system;

a door drive having a control unit;

a programmable computer having a memory for storing a plurality of hand vein profiles for a plurality of persons, wherein said hand vein scanner scans a hand of the person seeking entry through said door system creating a current hand scanned profile for the person and said hand vein scanner compares said current hand scanned profile with said plurality of hand vein profiles stored in said memory of said programmable computer and, when said current hand scanned profile matches a hand vein profile stored in said memory of programmable computer, a control signal is sent to said control unit for operating said door drive for opening or closing said door panel, said programmable computer and said memory being integrated with said door panel with said programmable computer being programmed and supplied with power via a network interface terminating in an edge of said door panel, or in a peripheral region, said network interface being a single, or only, interface between said door panel and said door frame, wherein by temporarily connecting an external computer to said network interface, said programmable computer is programmable and said network interface is able to be connected for a power supply for operation.

2. The door system according to claim 1, wherein said network interface is a USB interface.

3. The door system according to claim 1, wherein said network interface is a wireless interface.

4. The door system according to claim 1, wherein said network interface is a wireless near field communication technology interface.

5. The door system according to claim 1, wherein said network interface is a wireless infrared interface.

6. The door system according to claim 1, wherein said network interface is a wireless ultrasound interface.

7. The door system according to claim 1, further comprising an additional door panel for forming a double-panel door with one of said door panel and said additional door panel is fitted with said hand vein scanner and said programmable computer.

8. The door system according to claim 1, wherein said door panel is a sliding door.

9. A door system, comprising:

a door frame;

a door panel within said door frame, said door panel having a hand vein scanner within said door panel for scanning a hand vein profile when a hand of a person is held before said hand vein scanner for identifying the person, said door panel having a first front planar panel side and a second rear planar panel side with a single said hand vein scanner being accessible to scan the hand of a person held before said hand vein scanner positioned in front of the first front planar panel side or when the hand of the person is held before said hand vein scanner when positioned in front of the second rear planar panel side, depending upon which direction the person seeks to pass through said door system;

a door drive having a control unit;

a programmable computer having a memory for storing a plurality of hand vein profiles for a plurality of persons, wherein said hand vein scanner scans a hand of the person seeking entry through said door system creating a current hand scanned profile for the person and said hand vein scanner compares said current hand scanned profile with said plurality of hand vein profiles stored in said memory of said programmable computer and, when said current hand scanned profile matches a hand vein profile stored in said memory of programmable computer, a control signal is sent via a signal cable to said control unit for operating said door drive for opening or closing said door panel, said programmable computer and said memory being integrated with said door panel with said programmable computer being programmed and supplied with power via a network interface terminating in an edge of said door panel, or in a peripheral region, said network interface being a single, or only, interface between said door panel and said door frame, other than said signal cable, wherein by temporarily connecting an external computer to said network interface, said programmable computer is programmable and said network interface is able to be connected for a power supply for operation.

10. The door system according to claim 9, wherein said network interface is a USB interface.

11. The door system according to claim 9, wherein said network interface is a wireless interface.

12. The door system according to claim 9, wherein said network interface is a wireless near field communication technology interface.

13. The door system according to claim 9, wherein said network interface is a wireless infrared interface.

14. The door system according to claim 9, wherein said network interface is a wireless ultrasound interface.

15. The door system according to claim 9, further comprising an additional door panel for forming a double-panel door with one of said door panel and said additional door panel is fitted with said hand vein scanner and said programmable computer.

16. The door system according to claim 9, wherein said door panel is a sliding door.

* * * * *